United States Patent [19]

Maier et al.

[11] Patent Number: 4,777,720

[45] Date of Patent: Oct. 18, 1988

[54] METHOD FOR MANUFACTURING MULTIPLE-WIRE BRUSH CONTACT

[75] Inventors: Karl Maier, Farmingville; Donald Larock, Holbrook, both of N.Y.

[73] Assignee: Precision Concepts, Inc., Shirley, N.Y.

[21] Appl. No.: 946,325

[22] Filed: Dec. 24, 1986

[51] Int. Cl.[4] ..... H01R 43/12

[52] U.S. Cl. ..... 29/826; 29/56.5; 200/292

[58] Field of Search ..... 29/826, 874, 56.5; 200/283, 292

[56] References Cited

U.S. PATENT DOCUMENTS

| | | | |
|---|---|---|---|
| 1,399,492 | 12/1921 | Krantz . | |
| 2,116,269 | 5/1938 | Kobzy . | |
| 2,613,432 | 10/1952 | Gilbert . | |
| 2,760,036 | 8/1956 | Raymer . | |
| 3,188,722 | 6/1965 | Lorch | 29/826 |
| 3,194,931 | 7/1965 | Plasko et al. | 29/826 X |
| 3,274,368 | 9/1966 | De Boo . | |
| 3,328,707 | 6/1967 | Louis et al. . | |
| 3,488,842 | 1/1970 | Rochette et al. | 29/826 |
| 3,581,388 | 6/1971 | Klug et al. . | |
| 3,628,245 | 12/1971 | Elmhurst et al. | 29/56.5 X |
| 3,639,878 | 2/1972 | Scheel . | |
| 3,646,375 | 2/1972 | Mader . | |
| 3,704,436 | 11/1972 | Froebe et al. . | |
| 3,733,573 | 5/1973 | Dieterich . | |
| 3,733,695 | 5/1973 | Frey, Jr. et al. . | |
| 3,755,892 | 9/1973 | Dieterich . | |
| 3,766,646 | 10/1973 | Froebe et al. . | |
| 3,781,986 | 1/1974 | Joslyn et al. . | |
| 3,818,588 | 6/1974 | Bates | 29/826 |
| 3,829,813 | 8/1974 | Klug et al. . | |
| 4,005,381 | 1/1977 | Klug . | |
| 4,342,893 | 8/1982 | Wolf . | |

*Primary Examiner*—Howard N. Goldberg
*Assistant Examiner*—Carl J. Arbes
*Attorney, Agent, or Firm*—Brumbaugh, Graves, Donohue & Raymond

[57] ABSTRACT

A method for manufacturing a multiple wire brush contact includes the steps of stamping a continuous strip of material so as to define a series of spaced blanks, each including a cross bar and a base mounting plate, separating side carrier portions, welding and soldering contact wires onto the cross bar portions, cutting and forming the contact wiper. The multiple wire brush contact assembly thus includes a base mounting plate that is separate from the cross bar and wire spring and that is used to handle and mount the assembly in a cooperating receiving space in a rotor or other element.

7 Claims, 2 Drawing Sheets

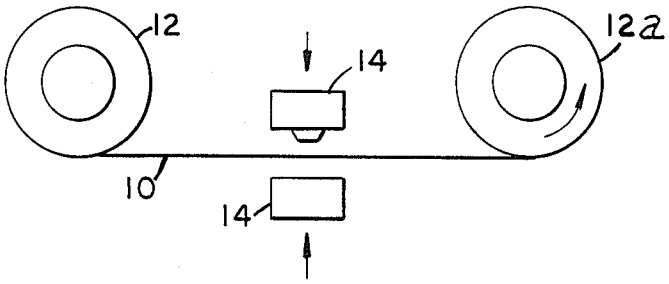
FIG. 1
FIG. 2a
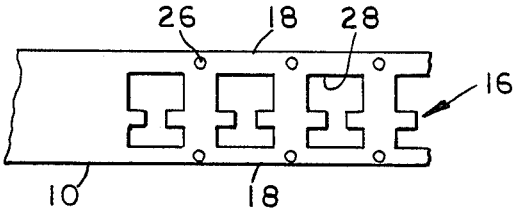
FIG. 2b
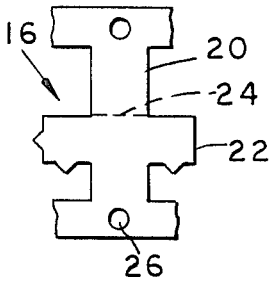
FIG. 3
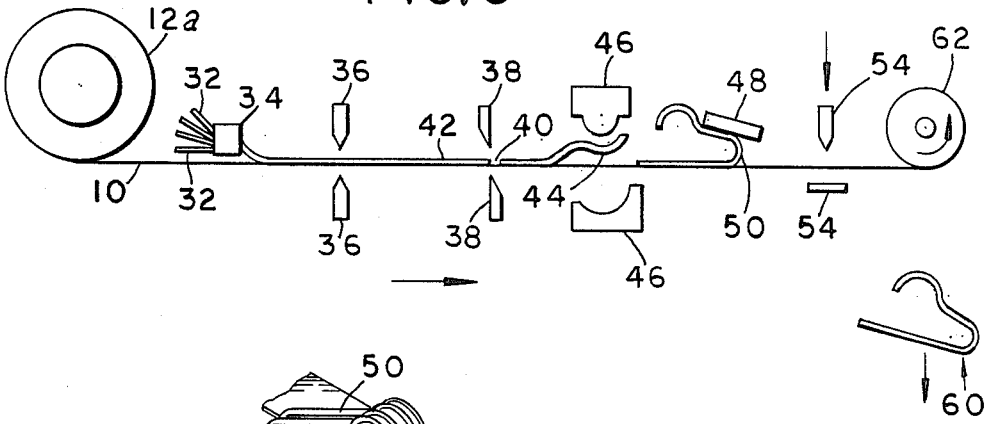
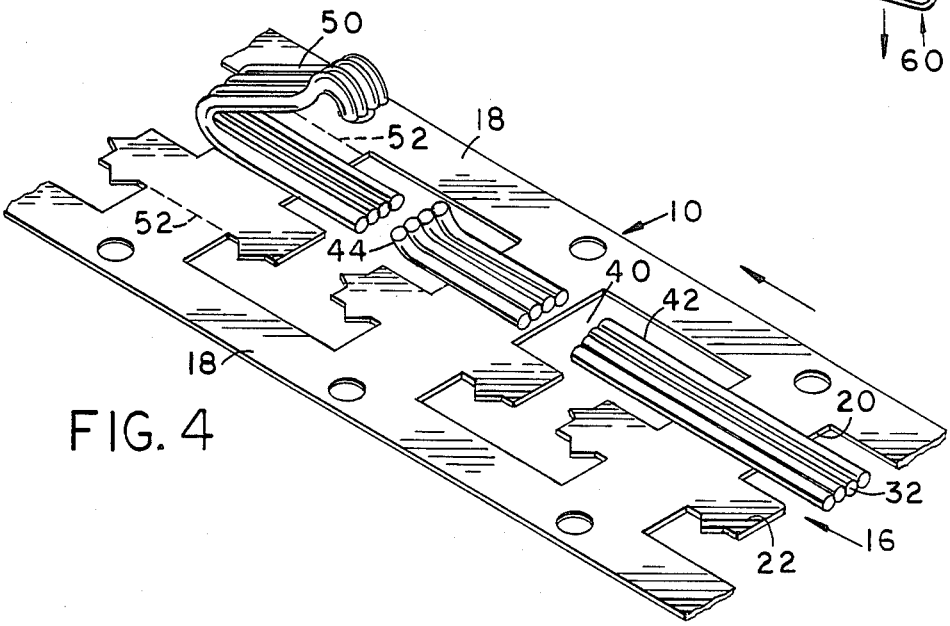
FIG. 4

METHOD FOR MANUFACTURING MULTIPLE-WIRE BRUSH CONTACT

BACKGROUND OF THE INVENTION

The present invention relates to the field of variable resistors and potentiometers, and more particularly to multiple-wire brush contacts therefor, and a method for making such contacts.

The preferred form of sliding contact, for engaging the resistance element in potentiometers and in many resistors, is formed of a large number of very fine gage metal wires that are held together and bent to form a multiple-wire brush.

A number of difficulties exist in the manufacture of these wire brush contacts. First, the wires need to be joined in some manner so as to be securely held and at the same time be given the proper electrical conductivity properties relative to one another. Also, because these wires are of such fine gage, they are difficult to handle. Moreover, while welding is the most evident way of securing the wires, great care must be taken so that the heat of welding does not alter the mechanical properties of the wires. Once the wires are held and bent to form a contact spring, a suitable way must be found to securely mount the contact in the potentiometer or resistor.

A wide variety of methods for making wire-brush contacts have been proposed. As an example, U.S. Pat. No. 4,186,483 to Laube et al. discloses forming a multiple-wire brush contact that is staked into a rotor blank. According to Laube a continuous strip of metal is stamped to form "L" shaped cross bars with a pair of weld projections. Multiple-metal wires are placed side-by-side over the cross bars and welded to the weld projections. The wires are cut from adjacent cross bars and bent to form a brush contact, and thereafter the L-portion of the cross bar is severed and discarded as scrap. Finally, a rotor blank is positioned under the contact, which is cut from the continuous strip and pushed directly into a slot in the rotor.

While the Laube patent permits continuous manufacture of contact wipers in rotor blanks, it would be desirable to be able to form multiple-wire brush contacts without the need to have the wire brush contact mounted in a blank, but that could still be securely mounted and handled without undue damage to the contact. It would also be desirable to find other methods of manufacturing multiple wire brush contacts that do not require welding to projections, as part of the process.

SUMMARY OF THE INVENIION

The present invention is a multiple-wire brush contact that may be assembled in a continuous process and that may be freely assembled and mounted in a rotor or other element without excessive handling or damage to the brush contact. The contacts are made by an improved process that, inter alia, does not require the presence of the rotor blank in the process and does not produce wire metal scrap.

A multiple wire brush contact assembly in accordance with the invention includes a cross bar or "bus bar", on which wires are mounted. A base mounting plate, that acts as a means for easily mounting the contact assembly in a rotor or other article, extends from a side edge of the cross bar both laterally and longitudinally to provide a mounting surface separate from, and relatively large in comparison to, the cross bar.

The base mounting plate may have one or more holes or projections to facilitate mounting of the finished wire brush contact. It may alternatively have one or more projections so that the plate is received by friction fit in a receiving space of a rotor blank. Preferably, the rotor element is formed to have a receiving space to lock the base plate of the contact assembly, and a surface underlying the cross bar to support the contact when compressed in use. The base mounting plate and rotor receiving space may take on any desired shape, and the receiving space may be formed to receive the base mounting plate and/or holes or projections on the plate by friction fit or mechanical interlock.

A multiple-wire brush contact assembly according to the invention is manufactured by a continuous process. First, a continuous metal strip is stamped to form assembly blanks having separating side carrier portions. Each blank includes a generally rectangular cross bar ad a base mounting plate projecting from a side edge of the cross bar. The blanks can be used as stamped to continue the process to form multi-wire brush contact assemblies or stored in rolls to allow the contact assemblies to be formed at a later time.

When the contact assemblies are to be finished, plural wires are positioned over adjoining blanks and attached to the adjoining cross bar, preferably by soldering and welding the wires. The carrier portions move the cross bars and attached wire to a station where the wires between adjoining cross bars are lanced, preferably scraplessly, and bent into a wire contact. Finally, each of the finished contacts can be cut from the carrier portions or left on the carrier for further processing.

Because of this process, a multiple-wire brush contact is produced which does not have to be immediately attached to a rotor or other housing element. The individual contact assemblies may be freely handled using the base mounting plate without damage to the wires and easily attached using the base mounting plate to the rotor of an article such as a variable resistor or potentiometer. In addition, the uncut contacts can be stored and automatically attached to rotors at any time.

Preferably, the base mounting plate of the contact is formed with one or more mounting holes or projections to facilitate attachment to the rotor element. The shape of the base mounting plate and hole or projections depends upon the cooperating receiving space in the rotor or other element to which the contact assembly is ultimately to be attached.

The invention will be best understood from the following description of preferred embodiments when read in connection with the accompanying drawings.

DESCRIPTION OF THE DRAWINGS

FIG. 1 is a schematic, side view of initial formation steps in manufacturing wire brush contacts in accordance with the invention;

Figure 5:
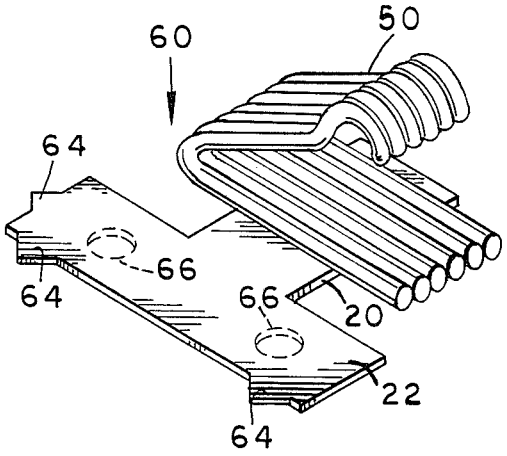
Figure 6:
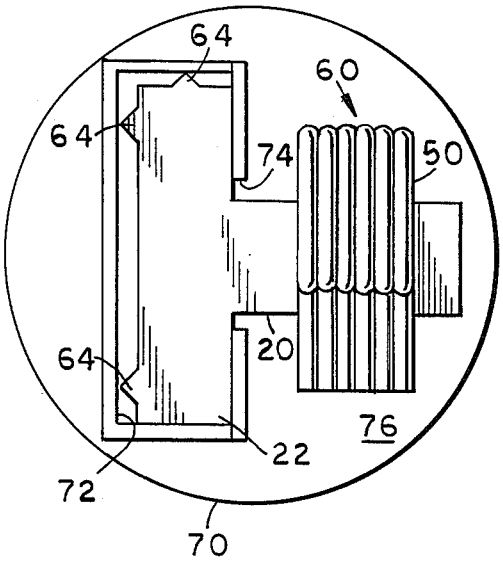
Figure 7:
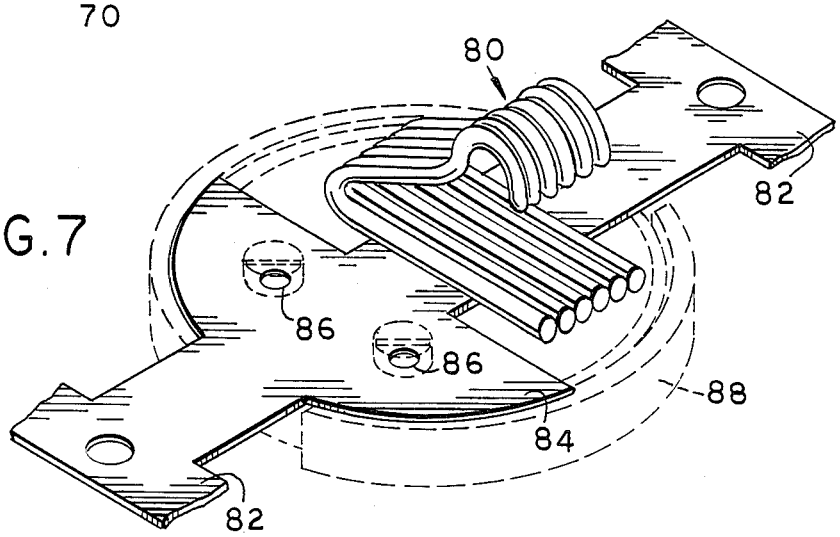

FIGS. *2a* and *2b* show a top view of one form of an assembly blank;

FIG. 3 is a side, schematic view of additional process steps in forming wire brush contacts in accordance with the invention;

FIG. 4 is a perspective view of a wire brush contact during three stages of formation;

FIG. 5 is a perspective view of an exemplary wire brush contact assembly in accordance with the invention;

FIG 6 is a top view of a wire brush contact assembly mounted in a rotor element for a potentiometer; and FIG. 7 is a perspective view of another embodiment of a wire brush contact assembly mounted in a rotor element.

DETAILED DESCRIPTION OF THE PREFERRED EMBODIMENT

Referring to FIG. 1, a continuous strip 10 of metal material is payed off a drum 12 and moved intermittently between a pair of die members 14. Die members 14 cooperate to stamp out portions from the continuous strip 10 to define a series of assembly blanks 16 with separating side carrier portions 18. As shown in FIGS. 2*a* and 2*b*, each of the blanks 16 includes a generally rectangular cross bar portion 20 and a base mounting plate 22 that projects from a side edge (indicated in dashed lines by 24) from the rectangular cross bar 20. Dashed line 24 is only for purposes of illustrating the invention, since the cross bar 20 and base mounting plate 22 are in fact one, unitary piece. If desired, die elements 14 may also stamp a plurality of pilot holes 26 that may be used for indexing the strip in later steps of the operation. However, as shown in FIG. 2*a*, the consecutive assembly blanks 16 define adjoining "windows" 28 which may be used as location indices, thus eliminating the need for any pilot holes.

It is preferable to coat the upper surface of the cross bar 20 of strip 10 with a thin coat solder. This may be done either before or after stamping but is preferably done prior to stamping and in most cases the strip 10 is purchased precoated with solder.

Once the metal strip 10 of assembly blanks 16 is stamped, as indicated in FIG. 1, it may be stored on a take-up roll 12*a* for later use. Alternatively, the assembly blanks may continue in accordance with the steps illustrated in FIG. 3, without being stored on an intermediate roll 12*a*.

FIG. 3 illustrates schematically additional process steps in completing the formation of a multiple-wire brush contact assembly, in which the stamped continuous strip 10 has been stored on an intermediate roll 12*a*. The strip 10 is directed along a continuous path in which, first, multiple wires 32 are passed through a guide 34 so that the wires 32 are precisely parallel to one another and guided to overlie the rectangular cross bars 20 of consecutive blank assemblies 16. The arrangement of the wires 32 on the rectangular cross bar 20 may best be seen in FIG. 4, where the strip 10 is moving in the opposite direction of FIG. 3.

Once positioned over the cross bar 20, the wires are subjected to a welding/soldering operation indicated at 36. The cross bar may have welding projections to form a narrow focus point for the welding energy to concentrate on. This operation is preferably done with a pair of welding tips, that are positioned above and below the wire surface, and impart current (heat) sufficient to partially weld the wires to the cross bar and to one another, and at the same time cause the soldering material to adhere to the wires. In particular, the attachment of the wires is done at a temperature lower than normally used for welding of wires. This process of partly welding and partly soldering the wires to the cross bar is preferable to welding the wires in accordance with known techniques, in that it can be carried out at a lower temperature and promotes better electrical flow across the wires and to the cross bar, and at the same time acts to inhibit the degradation of the mechanical properties of the wires that may be caused by high welding temperatures. Other techniques such as ultrasonic, electrical or heat and pressure welding can be used to join the wires to the cross bar provided a conductive interface between the cross bar and wires is formed, for example by use of other metallurgical bonding material or conductive adhesives.

Once the wires are attached to the cross bars 20, the strip moves to a cutting station 38, in which the wires are scraplessly lanced as indicated at 40 in FIG. 4. In FIG. 4, the space between the cut wires at 40 is exaggerated for the purpose of clarity; however, in reality, the cross bars 20 are spaced closely enough together so that, when the wires are cut, the forward length of wires 42 is just sufficient to form the desired length of wiper spring, as described further on.

Referring again to FIG. 3, the carrier 10 moves the blanks and cut wire strip 42 to position the ends 44 of the wire strip between a pair of die members 46. The die members are moved together and bend the ends 44 of the wire contact strip 42 into a desired shape of a brush contact in a manner well known. Thereafter, also using known techniques, the free-end 42 of the wires is bent back, for example using element 48, into the shape of a wiper spring, as indicated by 50 in FIGS. 3 and 4.

Once the brush contact 50 is fully cut and formed, the contact blank can be cut from the carrier portions 18, as indicated by phanton lines 52 in FIG. 4, by punch and die elements 54. The finished contact spring assembly, which is indicated by 60 in FIG. 3, then falls free of the carrier strip 10. The residual carrier portions may be wound on a take-up reel 62 as scrap. In the alternative only one carrier portion can be removed and the brush contact can be rolled up in the remaining carrier portion (using appropriate spacing to avoid crushing the brush). The user could then use the reel of brushes for individual or automatic assembly.

FIG. 5 illustrates a finished form of a cut multiple wire brush contact assembly 60, containing a wire brush spring 50 mounted on a generally rectangular cross bar 20 and a base mounting plate 22 projecting from one of the side edges of the cross bar 20 both laterally and longitudinally to provide a mounting surface separate from, and relatively large in comparison to, the cross bar 20. As formed, the mounting base plate 22 includes a plurality of edge projections 64 that are used to facilitate mounting of the assembly 60 on a rotor, as described further on. Alternatively, or in addition, one or more mounting holes 66, indicated in phantom, may be formed in the plate 22.

FIG. 6 illustrates a rotor 70 of the kind used in a potentiometer. The rotor 70 has a receiving space 72 which is shaped to cooperate with the base mounting plate 22 of the multiple wire brush contact assembly 60. In the example of FIG. 6, the receiving space 72 is generally rectangular for receiving the plate 22, and leaves an opening 74 through which the cross bar 20 can project. The base mounting plate 22 is pressed into the receiving space 72, such that projections 64 engage the walls of the receiving space, and cross bar 22 projects out of it in the manner shown. The top surface 76 of the rotor 70 underlies the cross bar 20, so as to form a supporting surface when the wiper spring 50 is compressed. The cross bar 20 is preferably, however, not attached to the rotor.

The contact assemblies may be mounted on the rotor bodies either manually or by machine and either individually or from an uncut roll. In either case, the assemblies are handled and mounted in the motor using the base mounting plates and not the wire and cross bar.

FIG. 7 discloses an alternative embodiment of a multiple wire brush contact 80, that has not as yet been severed from the carrier strip 82. The base mounting plate 84 in the embodiment of FIG. 7 is semi-circular in shape, and includes a pair of mounting holes 86. An exemplary rotor 88 is indicated in phantom to show the attachment of the wire brush contact 80 to the rotor 88 while still attached to the carrier strip. The rotor 88 which is positioned beneath the wire contact may include threaded holes aligned with holes 86 in the plate 84, so that the wire brush contact assembly 80 may be mounted on 88 with small screws. If desired, the rotor 88 may be formed with upstanding walls, or with horizontal groove guides, to receive and align edge portions of the base mounting plate 84 to ensure precise orientation of the spring on the rotor 88. Using this method the contact is mounted in the rotor and continues on the carrier strip in order that it can be rolled up and delivered to a user fully assembled for individual or automated use.

The foregoing represents descriptions of preferred embodiments of the invention. Variations and modifications of the embodiments shown and described in connection with FIGS. 1–7 will be apparent to persons skilled in the art, without departing from the inventive concepts disclosed herein. For example, while the invention has been shown and described with reference to a multiple wire brush spring, it is possible to implement the invention using other types of contacts, which are mounted on, or an integral part of, a cross bar portion, in which a base mounting plate projecting from the cross bar provides a mounting surface for the element that is separate and apart from the contact. Also, while two examples of base mounting plates have been shown, other shapes, and projections or holes, forming part of cooperating mounting means with a rotor or other element, may be readily employed. Also, the wires need not be put down lengthwise along the strip, but can be positioned widthwise or at an angle. This can be accomplished for example by preparing a blank in which the cross bar 20 and base mounting plate 22 extend from the side carrier portion at an angle other than 90°. All such modifications are intended to be within the scope of the invention, as defined in the following claims.

I claim:

1. A method for manufacturing a multiple-wire brush contact, comprising the steps of: stamping a continuous strip of material so as to define a series of spaced blanks separating side carrier portions, wherein each blank includes a generally rectangular cross bar having a side edge and a base mounting plate projecting from said side edge a distance to provide a mounting surface, separate from said cross bar, of an area sufficient to mount and support the cross bar; and attaching plural contact wires onto said cross bar and cutting and forming said contact wires.

2. A method as defined in claim 1, wherein said brush contact is cut from at least one of said carrier portions.

3. A method as defined in claim 1, wherein said wires are attached to said cross bar by welding and soldering.

4. A method as defined in claim 3, and further comprising the step of providing a layer of soldering material on said strip prior to welding and soldering said wire, said welding and soldering step including fusing mechanically together said contact wires and said strip of material by at least one of high heat, pressure ultrasonic and electrical energy.

5. A method as defined in claim 1, wherein said base mounting plate also extends longitudinally from said widthwise edge to provide a mounting surface relatively large in comparison to said cross bar.

6. A method as defined in claim 5 and further comprising the step of mounting the brush contact assembly in an article for use in a device for regulating voltage having means cooperating with the base mounting plate for securely mounting the brush contact assembly in said article.

7. A method as defined in claim 1, wherein said contact wire cutting and forming step includes scraplessly lancing each of said wires and bending said contact wires so as to form a contact spring.

* * * * *